US006821165B1

(12) United States Patent
Chang

(10) Patent No.: US 6,821,165 B1
(45) Date of Patent: Nov. 23, 2004

(54) CONTACT PINS IN AN ELECTRIC CONNECTOR

(75) Inventor: Che-Chia Chang, Taipei Hsien (TW)

(73) Assignee: Comax Technology Inc., Taipei Hsien (TW)

( * ) Notice: Subject to any disclaimer, the term of this patent is extended or adjusted under 35 U.S.C. 154(b) by 0 days.

(21) Appl. No.: 10/462,624

(22) Filed: Jun. 17, 2003

(30) Foreign Application Priority Data

May 6, 2003 (TW) ..... 092208225 U

(51) Int. Cl.[7] ..... H01R 4/48
(52) U.S. Cl. ..... 439/861
(58) Field of Search ..... 439/861, 860, 439/858

(56) References Cited

U.S. PATENT DOCUMENTS 2,062,690 A * 12/1936 Weynand ..... 439/861
3,116,101 A * 12/1963 Kikta ..... 439/787
3,245,031 A * 4/1966 Barney et al. ..... 439/861
4,752,244 A * 6/1988 Kuhl et al. ..... 439/635
5,224,885 A * 7/1993 Youngfleish ..... 439/861
5,292,260 A * 3/1994 Sinisi et al. ..... 439/441

* cited by examiner

*Primary Examiner*—Gary Paumen
(74) *Attorney, Agent, or Firm*—Troxell Law Office PLLC

(57) ABSTRACT

A set of contact pins in an electric connector are electrically coupled to another set of contact pins in an opposite connector and joined to a set of core wires in a cable. Each of the contact pins includes a coupling end and a wire connecting end. The coupling is corresponding to the opposite connector and provided with a contact part and the wire connecting end is corresponding to the core wires and provided with a wire connecting part. The wire connecting part is arranged an elastic holding device to retain one of the core wires instead of by way of soldering.

6 Claims, 6 Drawing Sheets

CONTACT PINS IN AN ELECTRIC CONNECTOR

BACKGROUND OF THE INVENTION

1. Field of the Invention

The present invention relates to contact pins in an electric connector and particularly to contact pins, which are electrically joined to a cable without the need of being soldered to core wires of the cable.

2. Description of Related Art

Although technology has leaded development of global industry, it brings in much pollution to ecological environment. Under being conscious of only one earth, all countries endeavor in environmental protection positively.

The use of lead in electronic products is a focus of environmental protection subject cared globally. Especially, the ingredient of lead in the tin-lead solder for soldering electronic components greatly pollutes the natural environment. Green material and green manufacturing process are two fields adopted by the manufacturers to resist the pollution. The green material means development and research of tin solder without lead to solve problems related to mechanical and metallurgic properties of non-lead alloy so as to obtain feature as the traditional tin lead solder does. The green manufacturing process means to investigate a way to obtain electrical contact between metals and maintain a specific standard electrical characteristics under a condition of less use of solder or not use of solder.

It is known that the method currently used for steady electrical connection between electronic components is soldering. As for the connector, contact pins therein has a wire connecting part at an end for being connected to core wires in the cable electrically, that is, the solder is heat up to join the contact pins and the core wires. However, the conventional way for electrical contact may pollute the natural ecology due to using tin lead solder.

SUMMARY OF THE INVENTION

A primary object of the present invention is to provide an electric connector with contact pins, which have elastic holding device to clamp core wires of a cable to form green manufacturing process instead of using solder, so that it is possible to avoid the lead contained in the solder contaminating the environment.

In order to achieve the object, the contact pins of the present invention are electrically coupled to another set of contact pins in an opposite connector and joined to the core wires in the cable. Each of the contact pins includes a coupling end and a wire connecting end. The coupling is corresponding to the opposite connector and provided with a contact part and the wire connecting end is corresponding to the core wires and provided with a wire connecting part. The wire connecting part is arranged to elastically retain the core wire firmly without the need of soldering work.

BRIEF DESCRIPTION OF THE DRAWINGS

The present invention can be more fully understood by reference to the following description and accompanying drawings, in which.

DETAILED DESCRIPTION OF THE PREFERRED EMBODIMENT

Figure 1:
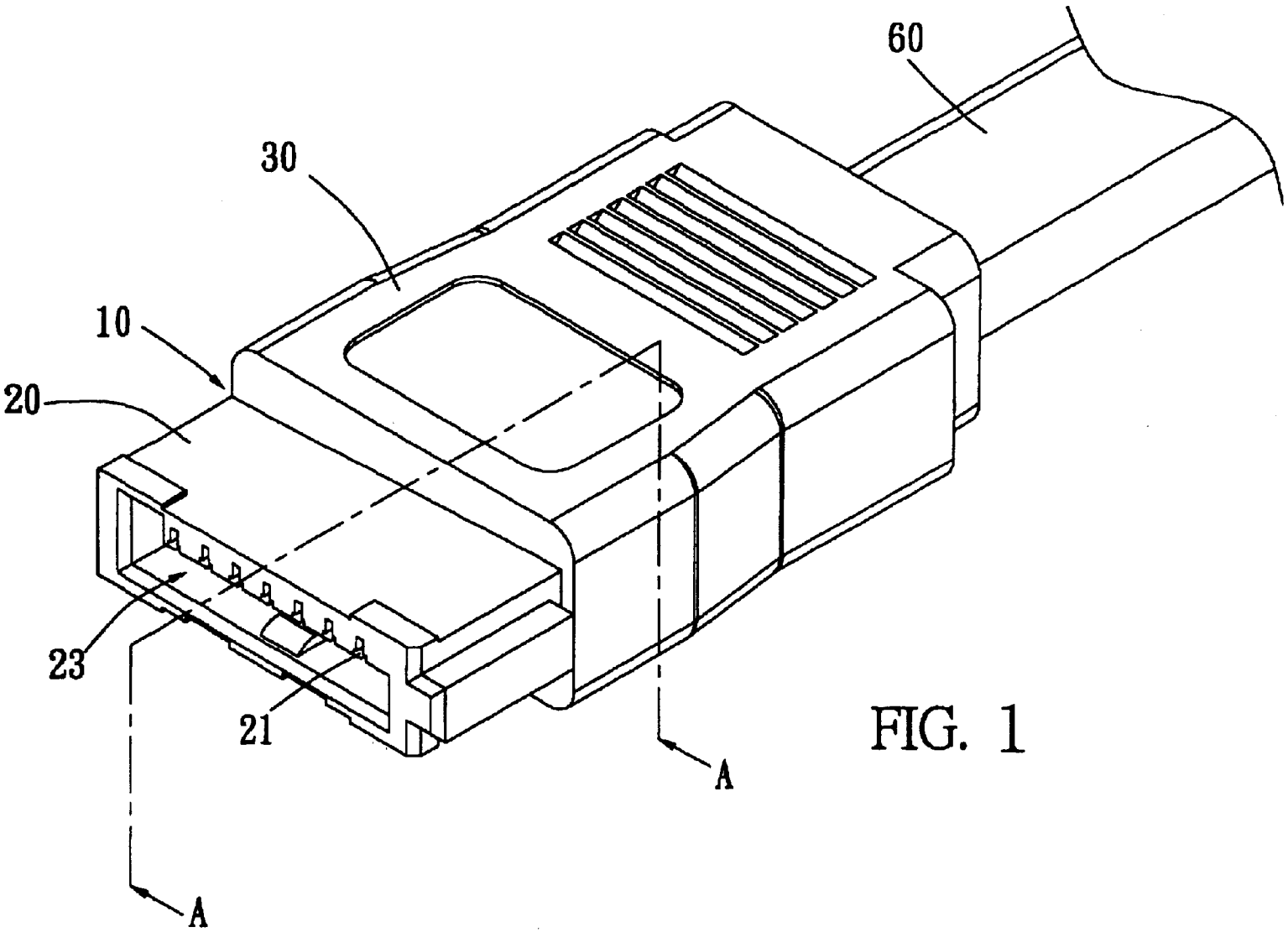
FIG. 1 is a perspective view of an electric connector according to the present invention.
Figure 4:
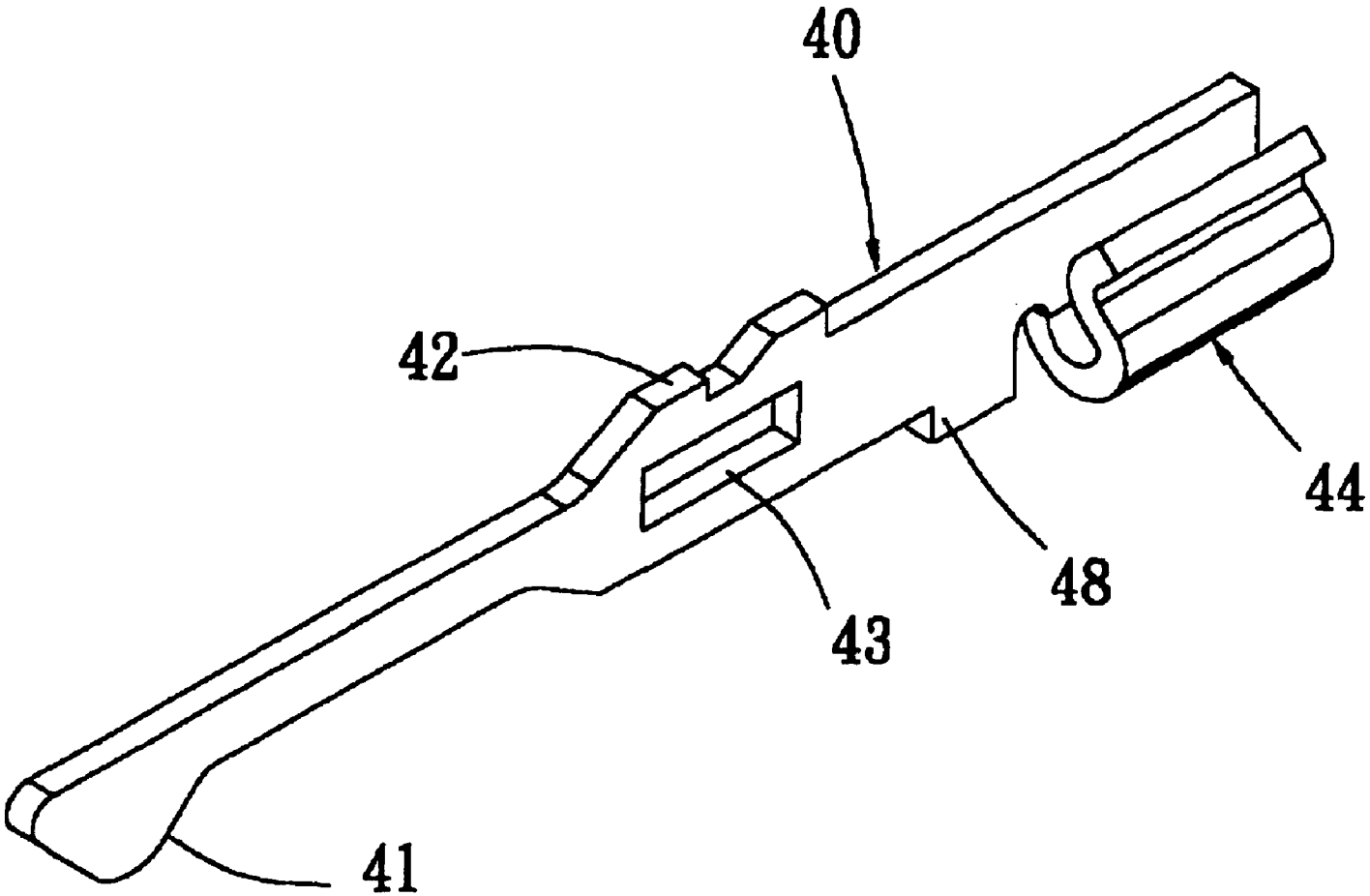
FIG. 4 is a perspective view of a contact pin according to the present invention.
Figure 6:
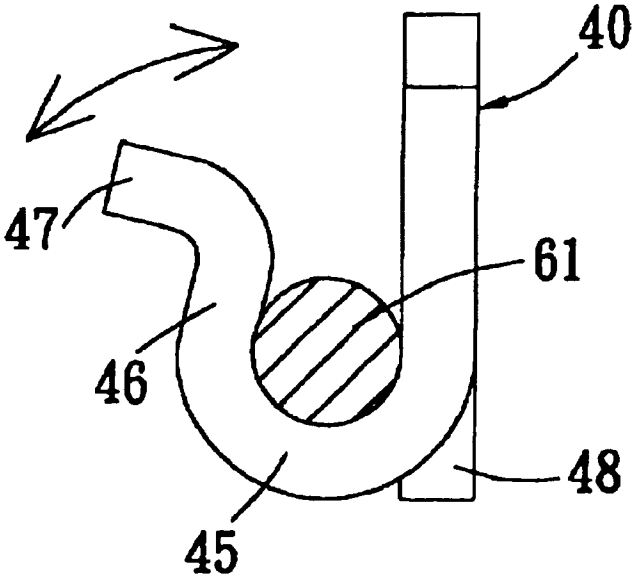
FIGS. 5 and 6 are plan views illustrating the contact pin being in a state of being used.
Figure 7:
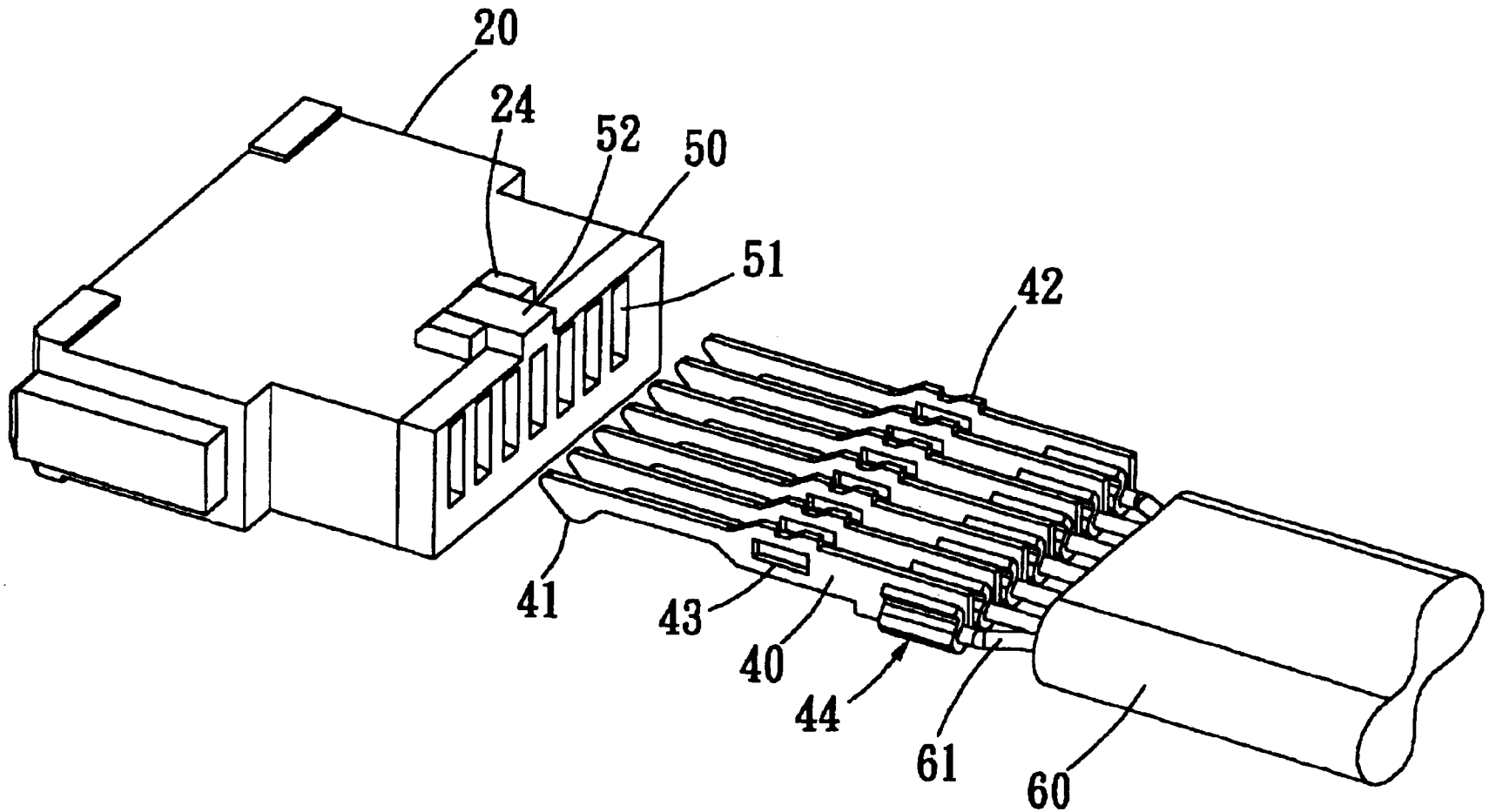
FIG. 7 is a perspective view illustrating a plurality of the contact pins being joined to the electric connector.

Referring to FIGS. 1, 4 and 7, a set of contact pins 40 of the present invention are received in the electric connector so as to be electrically coupled to another connector (not shown) and a cable 60. The contact pins 40 have a coupling end to be joined to an opposite connector and a wire connecting end to be joined to the cable 60. Hence, the electric connector of the present invention includes an insulation main body 10 in addition to the contact pins 40 so as to cover the contact pins 40 and part of the cable 60. Each contact pin 40 at the coupling end thereof has a contact part facing the opposite connector and at the wire connecting end thereof has a wire connecting part 44 for elastically holding one of core wires 61 in the cable 60 instead of being treated with soldering for being electrically joined to the cable 60.

Figure 2:
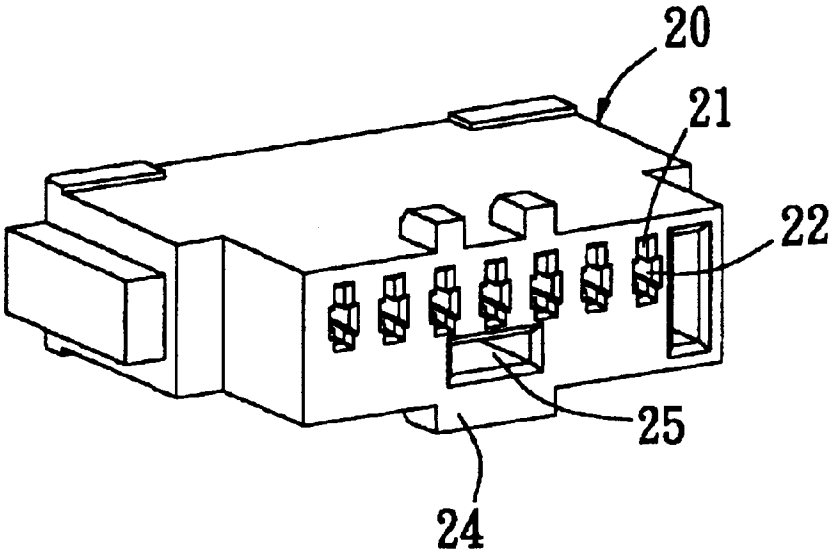
FIG. 2 is a perspective view of the first casing of the electric connector shown in FIG. 1.

The insulation body 10 is composed of a first casing 20 and a second casing 30. The first casing 20 is provided with a plurality of receiving grooves 21 for being inserted with the contact pins 40 as shown in FIG. 2. Each of the receiving grooves 21 at the periphery thereof at least has a space part 22 being possible for changing interface environment between contact pins 40 and forms an insertion opening 23 at the coupling end thereof for exposing the contact part 41 of each contact pin 40 so as to connect the opposite connector. The first casing 20 at the inner end next to the wire connecting parts 44 of the contact pins 40 is provided with at least a locating device composed of lower and high projection pieces 24 so as to be fixedly attached with the second casing 30. The second casing 30 can be directly made with injection molding to integrally cover the contact pins 40 and part of the cable 60.

Figure 3:
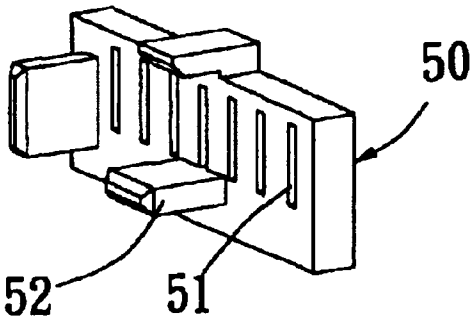
FIG. 3 is a perspective view of a baffle used in the electric connector shown in FIG. 1.

Referring to FIG. 3, the first casing 20 at the inner end thereof is provided with a baffle 50 to prevent the plastics from entering the receiving grooves 21 during the second casing 30 being fabricated so as not to affect the electric features of the contact pins 40. The baffle 50 has a plurality of slots 51 for being pierced with the contact pins 40. The first casing 20 has a locating groove 25 and the baffle 50 at the inner side thereof extends a locating tenon 52 corresponding to the locating groove 25 so that the baffle 50 can be fixed in place conveniently.

Figure 8:
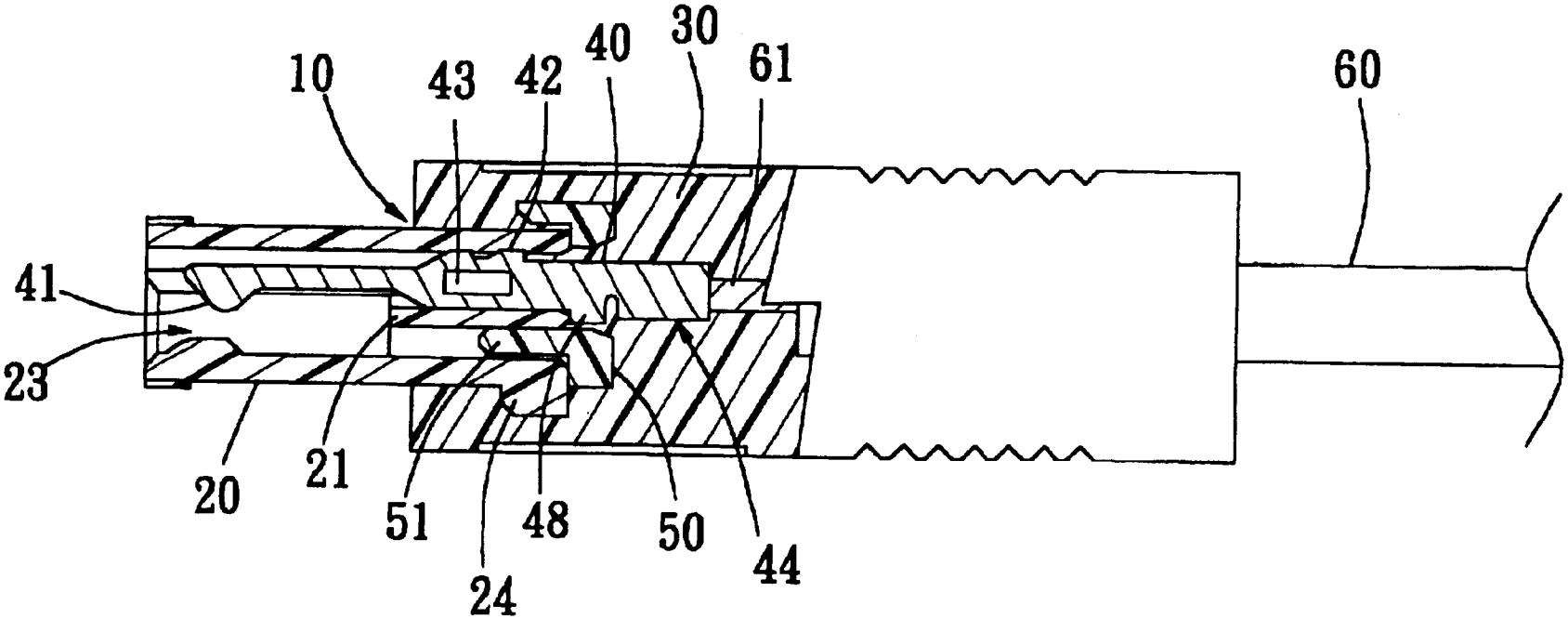
FIG. 8 is a sectional view along A—A shown in FIG. 1.

Referring to FIGS. 4 and 8, each of the contact pins 40 at the middle section thereof has a lateral interfere part 42 in addition to the contact part 41 and the wire connecting part 44 so that the contact pins 40 can interfere with the first casing 20 once the contact pins 40 enter the receiving grooves 21. Further, a stop part 48 is disposed at a lateral side opposite to the interfere part 42 to retain the contact pin 40 in place. A hollow part 43 is disposed at the middle area of the contact pin 40 under the interfere part 42 to enhance the elasticity of the contact part 41.

Figure 5:
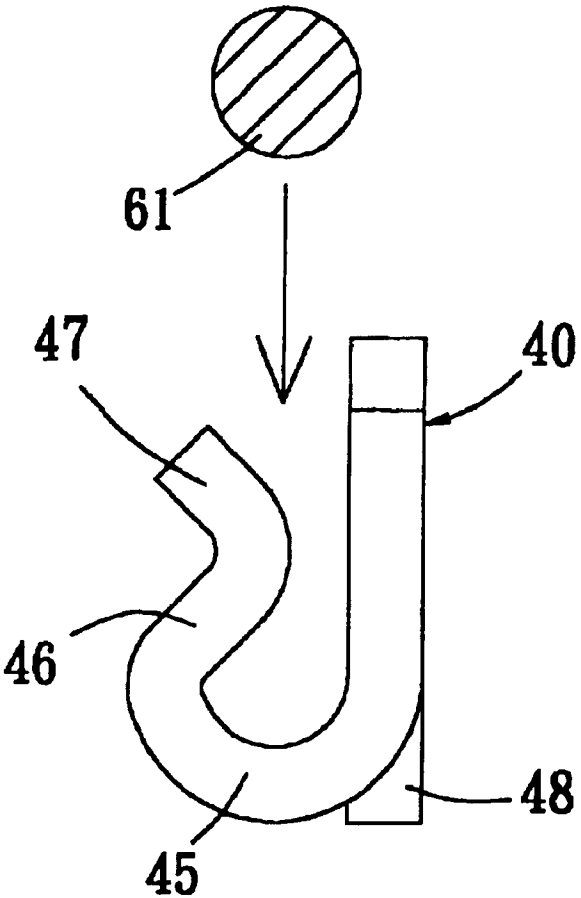

Referring to FIG. 5 in company with FIG. 4 again, the wire connecting part 44 has a preset length extending longitudinally and radially. The wire connecting part 44 includes an arched holding part 45 with the inner diameter thereof slightly less than the diameter of each core wire 61 in the cable 60, an elastic press part 46 extending from the holding part 45 for locating the core wire 61 and a guide part 47 extending inversely from the press part 46 as an inlet for the core wire 61. Thus, the core wire 61 can be pressed into the holding part 45 via the press part 46 from the guide part 47 so that the outer surface of the core wire 61 can keep contact with the inner surface of the wire connecting part 44 with a sound electrical connection.

Referring to FIGS. 5, 6, 7 and 8 again, the contact pins 40 can be made of conductive material by way of integrally cutting and bending. The first casing 20 is made with the receiving groove 21, the space part 22 and the insertion opening 23 and the first casing 20 at the inner end thereof provides a locating device with projection pieces 24 at the top and the bottom thereof for the second casing 30 being joined to the first casing 20 for use.

Then, the locating tenon 52 of the baffle 50 is inserted into the locating groove 25 of the first casing 20 to form plastics resistant device so as to avoid the plastics entering the receiving grooves 21. In the meantime, in order to electrically contacting with the contact pins 40, the core wire 61 of the treated cable 60 is placed at the inlet formed by the guide part 47 of the wire connecting part 44 flatly and then is pressed down to squeeze the pressing part 46 so that the pressing part 46 is biased outward and results in elastically deformation. Under this circumstance, the opening is forced to become wider for admitting the core wire 61 and the pressing part 46 bounces back after the core wire 61 entering the holding part 45 such that the core wire 61 can be located and pressed effectively to contact the inner surface of the wire connecting part 44 with an excellent electrically contact.

Next, the contact pins 40 are inserted into the receiving grooves 21 of the first casing 20 via the slots 51 of the baffle 50 and friction between the interfere parts 42 of the contact pins 40 and the wall surface of the first casing 20 generates deformation with the stop part 48 resisting lateral sides of the first casing 20 to limit the displacement of the contact pins 40 to an optimum position.

Finally, the second casing 30 is formed by way of plastics injection molding to cover the first casing 20 from the middle section thereof extending to the wire connecting end so as to protect the contact between the contact pins 40 and the core wires 61. Further, the second casing 30 engages with the projection pieces 24 to intensify the entire strength thereof so that a connector of the present invention can be constituted completely.

It is appreciated that the connector of the present invention provides contact pins 40 to hold the core wires 61 of the cable 60 elastically to avoid use of solder, which is possible to contaminate environment.

While the invention has been described with reference to a preferred embodiment thereof, it is to be understood that modifications or variations may be easily made without departing from the spirit of this invention, which is defined by the appended claims.

What is claimed is:

1. A set of contact pins having longitudinal axes in an electric connector, being electrically coupled to another set of contact pins in an opposite connector and being joined to a set of core wires in a cable, the core wires having longitudinal axes comprising:

a coupling end, corresponding to the opposite connector and being provided with a contact part; and a wire connecting end, corresponding to the core wires and being provided with a wire connecting part; wherein the wire connecting part is characterized in that an elastic holding device is provided to retain one of the core wires instead of by way of soldering wherein the core wires are inserted in to the respective elastic holding devices in a direction normal to the longitudinal axes of the core wires and the contact pins.

2. The set of contact pins in an electric connector as defined in claim 1, wherein the wire connecting part further comprises an arched holding part with an inner diameter thereof initially slightly less than a diameter of each core wire and a pressing part extending from the holding part to elastically locate one of the core wires.

3. The set of contact pins in an electric connector as defined in claim 2, wherein the wire connecting part has a guide part extending from the pressing part with an inversed bend to form an inlet for admitting one of the core wires.

4. The set of contact pins in an electric connector as defined in claim 1, wherein each of the contact pins further comprises a lateral interfere part.

5. The set of contact pins in an electric connector as defined in claim 4, wherein each of the contact pins has a hollow part corresponding to the lateral interfere part.

6. The set of contact pins in an electric connector as defined in claim 1, wherein each of the contact pins is provided with a space part for accommodating elastic deformation.

* * * * *